US011877641B2

(12) United States Patent
Bickford

(10) Patent No.: US 11,877,641 B2
(45) Date of Patent: Jan. 23, 2024

(54) APPLICATOR WITH EXPANDING SURFACE AREA MECHANISM

(71) Applicant: L'Oreal, Paris (FR)

(72) Inventor: William R. Bickford, Scotch Plains, NJ (US)

(73) Assignee: L'Oreal, Paris (FR)

( * ) Notice: Subject to any disclaimer, the term of this patent is extended or adjusted under 35 U.S.C. 154(b) by 221 days.

(21) Appl. No.: 17/008,359

(22) Filed: Aug. 31, 2020

(65) Prior Publication Data

US 2022/0061502 A1 Mar. 3, 2022

(51) Int. Cl.
*A45D 40/26* (2006.01)
*A45D 34/04* (2006.01)

(52) U.S. Cl.
CPC ..... *A45D 40/267* (2013.01); *A45D 34/046* (2013.01); *A45D 2200/10* (2013.01)

(58) Field of Classification Search
CPC ..... A45D 40/267; A45D 34/046; A45D 2200/10; A45D 40/262; A45D 40/264; A45D 34/043
USPC ..... 132/200
See application file for complete search history.

(56) References Cited

U.S. PATENT DOCUMENTS

| | | | | |
|---|---|---|---|---|
| 7,467,905 | B2 | 12/2008 | Habatjou | |
| 8,191,559 | B2 | 6/2012 | Bickford | |
| 8,851,775 | B2 * | 10/2014 | Jacob | A45D 40/26 401/122 |
| 9,032,972 | B2 | 5/2015 | Viegas | |
| 10,064,475 | B2 | 9/2018 | Wolfsgruber et al. | |
| 2012/0045268 | A1 * | 2/2012 | Geuther | A45D 33/14 401/121 |
| 2015/0366325 | A1 | 12/2015 | Wolfsgruber | |
| 2018/0055205 | A1 * | 3/2018 | Pires | A45D 40/267 |
| 2019/0200725 | A1 * | 7/2019 | Böhm | A45D 29/00 |

FOREIGN PATENT DOCUMENTS

| | | | | |
|---|---|---|---|---|
| EP | 1 652 449 | A2 | 5/2006 | |
| EP | 1652449 | A2 * | 5/2006 | A45D 40/265 |
| JP | 2015 126822 | A | 7/2015 | |
| JP | 2015126822 | A * | 7/2015 | |
| KR | 200408108 | Y1 * | 2/2006 | A46B 5/0045 |
| KR | 2017 0033727 | A | 3/2017 | |
| WO | WO-2004077987 | A1 * | 9/2004 | A45D 2/48 |
| WO | WO-2008072585 | A1 * | 6/2008 | A45D 34/046 |
| WO | 2010/135052 | A2 | 11/2010 | |

(Continued)

OTHER PUBLICATIONS

EP1652449A2 (Gueret Jean-Louis) (L'Oreal) Make-up kit for keratinous fibres, May 3, 2006. [retrieved on Jun. 27, 2022], Translation retrieved from: Espacenet (Year: 2006).*

(Continued)

*Primary Examiner* — Amy R Sipp
*Assistant Examiner* — Courtney N Huynh
(74) *Attorney, Agent, or Firm* — Christensen O'Connor Johnson Kindness PLLC

(57) ABSTRACT

An applicator includes a first applicator tool and a second applicator tool, wherein the first and second applicator tools are positioned diagonally apart from each other; and the applicator has an overall width that decreases with the flexing of a spring holding the first and second applicator tools as the first and second tools overlap with each other.

17 Claims, 5 Drawing Sheets

(56) References Cited

FOREIGN PATENT DOCUMENTS

| | | | | |
|---|---|---|---|---|
| WO | WO-2010135052 | A2 * | 11/2010 | ..... A45D 34/045 |
| WO | 2018130371 | A1 | 7/2018 | |

OTHER PUBLICATIONS

KR200408108Y1 (Ungho Song) Folding brush, Feb. 7, 2006. [retrieved 11/03/022], Translation retrieved from: Google Patents (Year: 2006).*

Plastics Today. admin 1. Plastics have designs on springs. Webpage [online]. Oct. 12, 1998 [retrieved on Apr. 10, 2023] Retrieved from plasticstoday.com: <URL:https://www.plasticstoday.com/plastics-have-designs-springs> (Year: 1998).*

Dupont. Design FYI Hytrel in Action. Product information overview [online]. 2017. [retrieved on Apr. 10, 2023] Retrieved from plasticportal.eu: <URL:https://www.plasticportal.eu/image/clanky/4365/pdf/9774.pdf> (Year: 2017).*

WO 2008072585 A1 (Kose Corp); Figla Co Ltd; Arai K; Yamada E; Danmura Y; Sawayanagi H; Takahashi H; Yoneda T; Nakatsuka A) Liquid Cosmetics Application Container, Jun. 19, 2008. [retrieved on Apr. 10, 2023], Translation retrieved from: Espacenet (Year: 2008).*

JP2015126822A (Furusato Shinichi) (Kao Corp) Liquid Cosmetic Application Tool, Jul. 9, 2015. [retrieved on Jun. 27, 2022], Translation retrieved from: Espacenet (Year: 2015).*

* cited by examiner

APPLICATOR WITH EXPANDING SURFACE AREA MECHANISM

SUMMARY

In an embodiment, a cosmetic applicator is disclosed that is composed of a moving mechanism that allows the applicator's surface area to fold into itself as it passes through small orifices such as found in wipers inside cosmetics packages, and then expands back to a static state (full size) for use in application of the cosmetic or other composition.

In an embodiment, the dynamic applicator is designed to rest in a state that is larger than the wiping orifice, contract or compress when passing through the wiping orifice and expand back to the resting state once the applicator has been removed from the package. This contraction and expansion is designed to occur in both directions when wiping out of the package, and also when inserting into the package.

In an embodiment, a benefit of the disclosed applicator configuration is to offer larger shapes and forms that would typically be challenging or not possible to wipe conventionally, and also to provide options for asymmetrical forms that when compressed or compacted can be effectively and uniformly wiped as they pass through the wiper.

In an embodiment, the larger forms and applicator surfaces can not only pass through a wiper orifice, but can wipe effectively (wiped by the orifice, and also be self-wiping by applicator surface to surface contact).

In an embodiment, the cosmetic applicator is provided with larger surfaces by contouring the travel/contact area of the applicator that interacts with the wiper.

In an embodiment, the cosmetic applicator has an integrated spring that allows the applicator to consistently pass through the wiping orifice and spring back to its static state for application after withdrawal of the application from the cosmetic package.

In an embodiment, the cosmetic applicator creates effective forms that compress and expand across one plane of motion, for example, one or more spatula expanding and contracting in width.

In an embodiment, the cosmetic applicator is provided with smooth surfaces for predictable application or with irregular patterns, such as sine waves, rough patterns (like on a key), combs, brushes or even syncopated patterns.

The applicator is ideal for application of makeup such as concealers and foundations, but also for eye shadow, skin creams and treatments, makeup removal, hair coloration (hair, brows, beards), depilatory application, exfoliation, and anti-acne creams.

This summary is provided to introduce a selection of concepts in a simplified form that are further described below in the Detailed Description. This summary is not intended to identify key features of the claimed subject matter, nor is it intended to be used as an aid in determining the scope of the claimed subject matter.

DESCRIPTION OF THE DRAWINGS

The foregoing aspects and many of the attendant advantages of this invention will become more readily appreciated as the same become better understood by reference to the following detailed description, when taken in conjunction with the accompanying drawings, wherein.

DETAILED DESCRIPTION

Many conventional cosmetic applicator systems require a wiper stage to clean the primed applicator to fully prepare the applicator before use. This wiping stage inherently limits the profile of the applicator due to the nature of the wiping function, and can significantly limit the size and shape of the applicator to be wiped. A typical cosmetic applicator can consist of a handle having a stem to which a spiral brush, for example, is formed on the end portion of the stem. The handle is used to manually control the brush to both load and then apply the cosmetic. The brush is passed into the wiper to load the brush with the cosmetic that is intended to be applied. The applicator handle can also serve to seal the cosmetic package when not being used. Conventionally, applicators are limited by the size of the orifice in the wiper. In accordance with this disclosure, an embodiment of an applicator is disclosed that increases the surface area of the applicator that can be used with conventionally-sized wipers.

Figure 1:
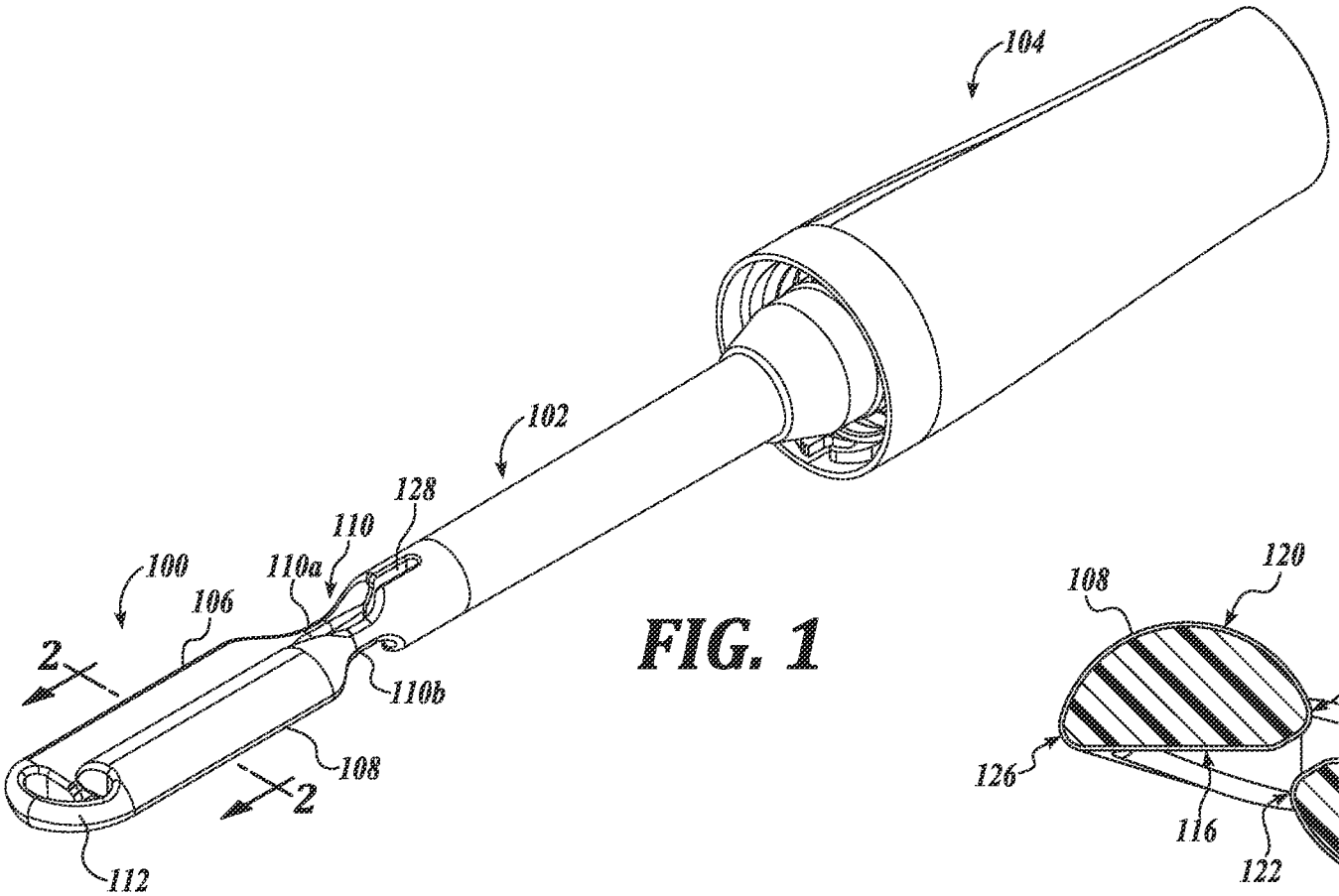
FIG. 1 is a diagrammatical illustration of an applicator in an expanded (static) state in accordance with an embodiment of this disclosure.

FIG. 1 is a diagrammatical illustration of an applicator 100 according to one embodiment. The applicator 100 according to this disclosure relates to that part that can be loaded with a composition and used to apply the composition. In an embodiment, the applicator 100 is connected to one end of the stem 102, and on the end opposite to the applicator 100, the stem 102 is connected to a handle 104, which can also function as a cap to seal a cosmetic package.

The applicator 100 includes a first 106 and a second 108 applicator tool. An applicator tool 106 and 108 as used in this disclosure can mean a tool used for the application of a composition. A tool can include, but is not limited to, a spatula with or without surface contouring, brush, comb, and the like. An applicator 100 can have the first and second applicator tools 106 and 108 be the same type of tool, or the first and second applicator tools 106 and 108 can be different tools. For purposes of the embodiment of FIGS. 1 and 2, the applicator tools 106 and 108 are spatulas. A spatula includes a tool that has at least one of the two major surfaces on opposite sides that is planar or a majority of the surface is flat. A spatula can also include surface contouring.

A spatula is only one representative example of an applicator tool to illustrate the aspects of this disclosure. The spatula configuration is intuitive, uses the motion to full advantage, and has a self-wiping aspect. In an embodiment, it is also possible for the applicator 100 to include brushes and combs for mascara, nail, hair coloration, and styling applications. The array of possible diverse applicator tools are only one aspect, and the applicator tools can be scaled to fit many different applications. Applicator 100 sizes can vary, for example, in the width direction (i.e., the larger dimension orthogonal to the length) is about 2 mm to 10 mm in diameter, but a larger orifice wiper (for a hair product for example) could be much larger. In an embodiment, the width dimension of the applicator 100 is the dimension that varies to allow the applicator 100 to pass through orifices having a dimension smaller than the width.

Further, most conventional wipers are axially symmetric, but applicators according to this disclosure can pass not only through circular orifices, but through elliptical orifices, polygonal orifices, or asymmetrical orifices conducive to cosmetic use.

Figure 2:
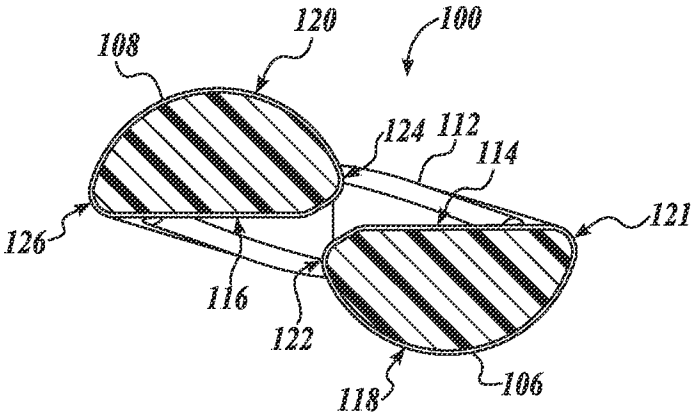
FIG. 2 is a diagrammatical illustration of a cross section of the applicator of FIG. 1.

In FIG. 2, the applicator tools 106 and 108 are shown to have a first major surface 114, 116 being planar or flat and a second major surface 118, 120 on the opposite side of the tool being convex (or semi-circular). In an embodiment, this cross section is maintained throughout the majority of the length of the first and second applicator tools 106, 108. The first major surfaces 114, 116 can also be described as interior surfaces, because they face inward toward each other, while the second major surfaces 118, 120 can also be described as exterior surfaces which face in opposite directions from each other. The first and second major surfaces on each applicator tool 106, 108 transition to one another via rounded edges 120, 122 for tool 106 and edges 124, 126 for tool 108. In an embodiment, the width dimension from the outermost edge 120 of tool 106 to the outermost edge 126 of tool 108 is about 2 mm to 10 mm. Therefore, in one embodiment, a single applicator tool has a width of about 1 to 5 mm, assuming little to no overlap, or smaller assuming some overlap between the tools. Therefore, the radius or depth of a single tool 106, 108 can be about 0.5 mm to 2.5 mm. Therefore, the overall depth of the applicator 100 is about 1 mm to 5 mm.

The exterior surfaces of the applicator 100, including the rounded convex major surfaces 118, 120 are the surfaces that will contact the wiper orifice. A purpose of the rounded major surfaces 118, 120 is to ensure that the first major planar surfaces 114, 116 travel the correct distance and are loaded with a specific amount of composition. Surfaces 114, 116 also remove excess formula on the outside of the stem rod 102 and applicator 100. This is done by forming the exterior shape of the applicator 100, including the second major surfaces 118, 120, to coincide with the shape of the wiper orifice. While a rounded or circular shape is illustrated as a cross section for applicator 100 in the compressed state, other shapes for the cross section can be used. When the exterior shape of the applicator 100 fails to match the orifice of the wiper, some composition will remain on these surfaces after wiping.

In an embodiment, the first and second applicator tools 106 and 108 have a similar length, which can be on the order of 1 to 5 times the width dimension of a single tool, thereby, the length dimension can be on the order of about 1 mm to 2.5 cm.

In an embodiment, the overall width dimension of the applicator 100 in the static state, i.e., the dimension from the outermost edge 120 of tool 106 to the outermost edge 126 of tool 108 is about the combined width of both tools 106, 108. In an embodiment, the overall depth dimension of the applicator 100 in the static state is about the combined depth of both tools 106, 108.

The above dimension are only given as a representative example, and other applicators can be larger or smaller than the example dimensions.

In an embodiment, the applicator tools 106, 108 are attached to a spring mechanism 110 on the proximal end of the tools 106, 108 and attached to a spring mechanism 112 on the distal end of the tools 106, 108. In an embodiment, the tools 106, 108 can be attached to a single spring on either the proximal or distal end. In an embodiment, the spring selection provides flexibility and torsion spring like mechanism on one or both ends of the applicator tools 106, 108 to create a consistent and predictable movement for wiping.

In an embodiment, the springs 110, 112 are elastic-type springs with memory. In an embodiment, proximal spring mechanism 110 connects the proximal ends of the applicator tools 106, 108 to the stem 102, and includes two narrow necks 110*a* and 110*b*. The neck 110*a* connects the proximal end of tool 106 to the stem 102, and neck 110*b* connects the proximal end of tool 108 to the stem 102. In an embodiment, necks 110*a* and 110*b* extend from the end of the stem 102 and parallel to the stem 102. In an embodiment, necks 110*a* and 110*b* are set apart from each. In an embodiment, the spring necks 110*a* and 110*b* are placed opposite to each other where the necks 110*a* and 110*b* extend to the outer perimeter of the stem 102.

In an embodiment, spring necks 110*a* and 110*b* can be made from a monolithic material, such that a single piece includes both necks 110*a* and 110*b*. In an embodiment, the necks 110*a* and 110*b* can also be integral with the respective tools they are connected to, and even further, the necks 110*a* and 110*b* of spring mechanism 110, the tools 106, 108, and the spring mechanism 112 can be fashioned from a single monolithic material, such as by 3-D printing, additive manufacturing, subtractive manufacturing, or molding. Suitable materials for the applicator would be polypropylene for sustained flexibility or a TPE/elastomeric materials, for example.

In an embodiment, the necks 110*a* and 110*b* have a smaller width and depth as compared to the tools 106, 108, so that bending takes place at the necks 110*a*, 110*b*. The length, width, and depth, dimensions of the spring necks 110*a* and 110*b* can be tested to ensure the adequate bending movement. In an embodiment, the applicator 100 and stem 102 can be manufactured as a single unitary part, and can be made of the same material. In an embodiment, the applicator 100 can be assembled from a plurality of parts.

In an embodiment, the distal spring mechanism 112 is an extension from the distal ends of tools 106, 108. In an embodiment, the distal spring mechanism 112 is a half loop connected tangentially from the distal end of the outermost edges 120, 126 of applicator tools 106, 108, but loops in a semi-circle to connect the outermost edge 120 of tool 106 to the outermost edge of tool 108. The half-loop spring 112 extends across the plane that divides the first applicator tool 106 from the second applicator tool 108. The half-loop spring mechanism 112 can be made of the same material so as to be monolithic and integral with tools 106, 108, but has a smaller width and depth as compared to the tools 106, 108, so that bending takes place at the half-loop spring 112.

In a relaxed state, the springs 110, 112 are configured to maintain the tools 106, 108 in the position shown in FIG. 2. When the springs 110, 112 are in a static state, the applicator of FIGS. 1 and 2 is in a first expanded state. In an embodiment, in the expanded state, the first major surfaces 114, 116 of the tools 106, 108 lie generally parallel to each other, such that the tools 106, 108, are positioned across from one another on opposite sides of a dividing plane dividing the two major surfaces 114, 116 of tools 106, 108. However, in an embodiment, the two major surfaces 114, 116 may cross the dividing plane, such that the major surfaces 114, 116 overlap in the depth direction. In an embodiment, the two major surfaces 114, 116 of tools 106, 108 may be spaced away from the dividing plane, such that there is no overlap of major in the depth dimension of tools 106, 108.

In an embodiment, the applicator tools 106, 108 lie diagonally apart from each other in the expanded state. In an embodiment, "diagonally apart" means that viewing a cross section cut orthogonal with respect to the length of the applicator tools 106, 108, such cross sections of tools 106, 108 lie diagonally apart. In an embodiment, there can be some overlap of the major surfaces 114, 116 or the rounded inside edges 122, 126 in the width dimension. In an embodiment, there can be no overlap and even some distance apart between the tools 106, 108 in the width dimension.

Figure 3:
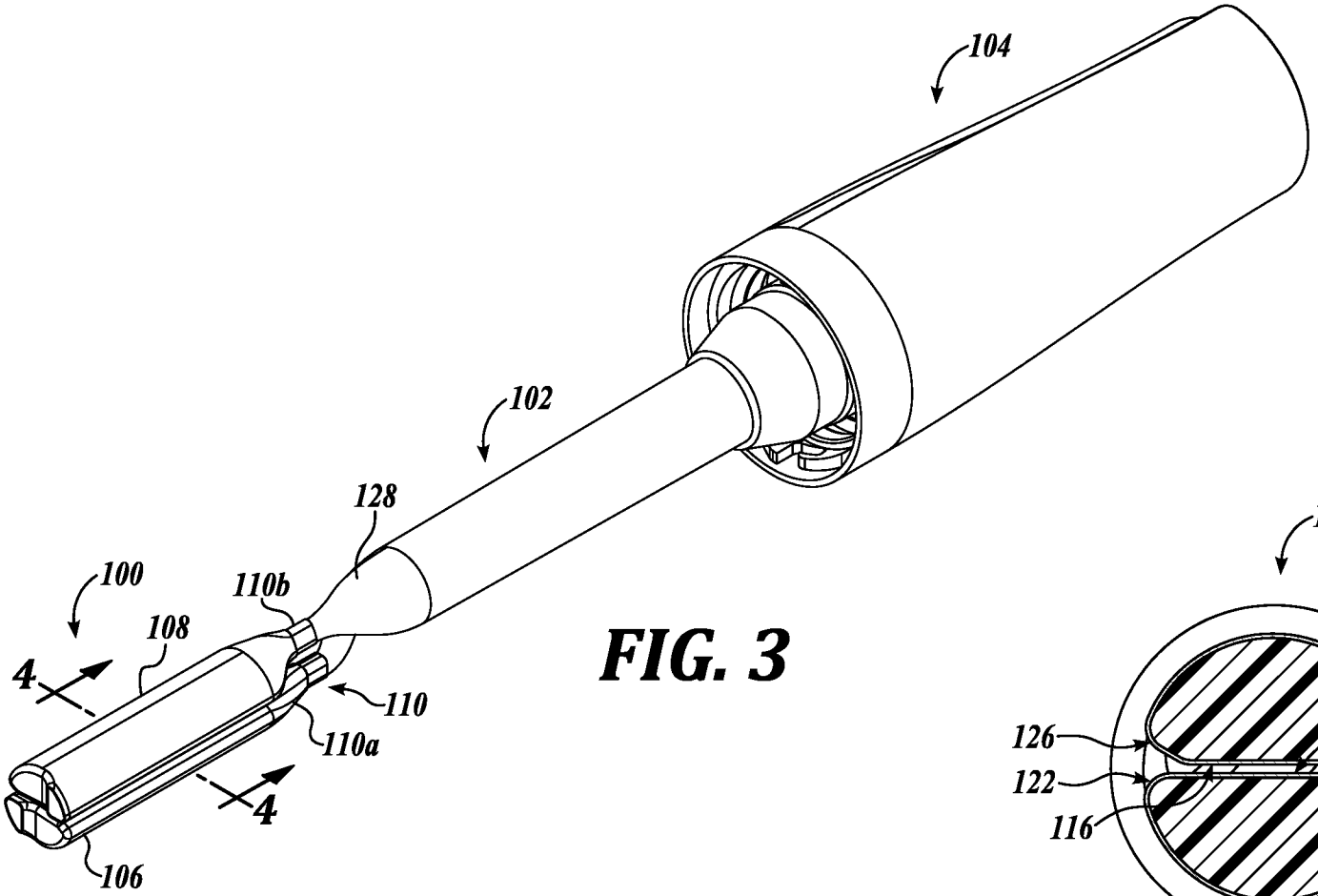
FIG. 3 is a diagrammatical illustration of the applicator of FIG. 1 in a compressed state in accordance with an embodiment of this disclosure.
Figure 4:
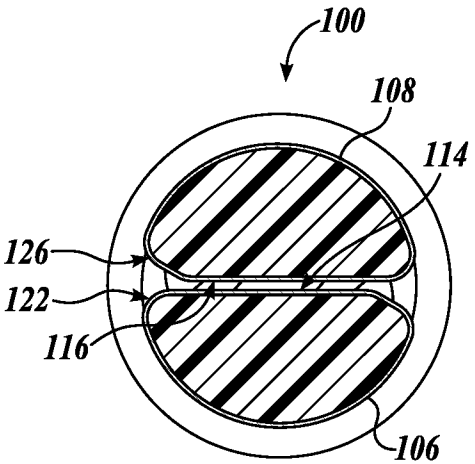
FIG. 4 is a diagrammatical illustration of a cross section of the applicator of FIG. 3.

FIGS. 3 and 4 show the tools 106, 108 in a compressed state, for example, upon entering or exiting the opening in a wiper. When passing through an opening that is narrower than the overall width of the applicator 100, the tools 106, 108 being made themselves of a non-compressible solid, will, as a result of springs 110 and 112, move mostly inwards in the width dimension sideways relative to each other while the major surfaces 114, 116 move past each other, but overall the tools 106, 108 may also twist or rotate upon compressing inwards. In an embodiment, the major surfaces 114, 116 may contact each other when moving past one another, and this movement can effectively provide a wiping action.

In an embodiment, protrusions can be added that project outward from the major surfaces 114, 116. Such protrusions can be used to control the amount of contraction and expansion. For example, placing protruding ribs along the length of one or both surfaces 114, 116 so as collide or interfere with each other can limit the expansion and contraction of the applicator tools 106, 108. Further, a protruding rib located on the outer edge of the surface plane can be used to limit the surface from continuing to travel.

In an embodiment, a torsion spring is part of the applicator 100. A torsion spring, such as springs 110, 112, can impart a parallel "cutting" movement to the applicator tools 106, 108 when passed through the wiper, which relaxes after leaving the package. It is possible to have only one spring 110 or 112 on one end of the applicator 100, but a single spring would create a different movement compared to a purely scissor-like cutting movement, and further couple such movement with a degree of rotation. In an embodiment, a rotation movement can also help with the wiping action.

The sideways and rotating movements may be determined by the geometry of springs 110, 112 and selection of materials such that the durometer of springs 110, 112 can be the same or different to the durometer of the tools 106, 108 to affect the degree of bending. The compression of tools 106, 108 reduces the overall width to allow the applicator 100 to pass through a narrower opening. In the compressed state, the springs 110, 112, are under tension which will return the tools 106, 108 to the expanded state once the springs 110, 112 are relaxed again. In the compressed state, the first major surfaces 114, 116 of the tools 106, 108 remain parallel to each other all along the length of the tools 106, 108, but, the major surfaces 114, 116 are almost or entirely overlapping each other, and the tools 106, 108 are no longer diagonally apart. In an embodiment, the tools 106, 108 are compressed so that the former innermost edge 122 of tool 106 becomes opposite to the outermost edge of 126 of tool 108. In an embodiment, the degree of compression of tools 106, 108 is determined by the width of the opening, i.e., dimeter if the opening is circular.

In an embodiment, the compression of applicator tools 106, 108 may only take place at and near that part of the length that is passing through the restriction opening, while the remainder of the length of tools 106, 108 may stay in a generally expanded state. This can be true, if for example, the tools 106, 108 are made of a highly elastic material that allows such degree of flexing.

In an embodiment, the applicator 100 is designed to double the surface contact area to apply a cosmetic formula as opposed to other applicators that must pass through the restricting size of a wiper orifice.

In an embodiment, when the tools 106, 108 are in the static expanded state, the combined width dimension of both tools 106, 108 is about double the width dimension when the tools 106, 108 are in the compressed state. As seen in FIG. 4, when the tools 106, 108 are overlapping, the overall width dimension is almost halved as compared to the expanded state shown in FIG. 2. Further, in the compressed state of FIG. 4, the overall width is about equal to the overall depth, thereby, making the cross-sectional profile appear as a circle to easily pass into and out of a circular opening. In an embodiment, the overall width and overall depth of the applicator 100 in the compressed state form a circumference whose diameter can be about the same or smaller relative to the diameter of the stem 102.

Figure 5:
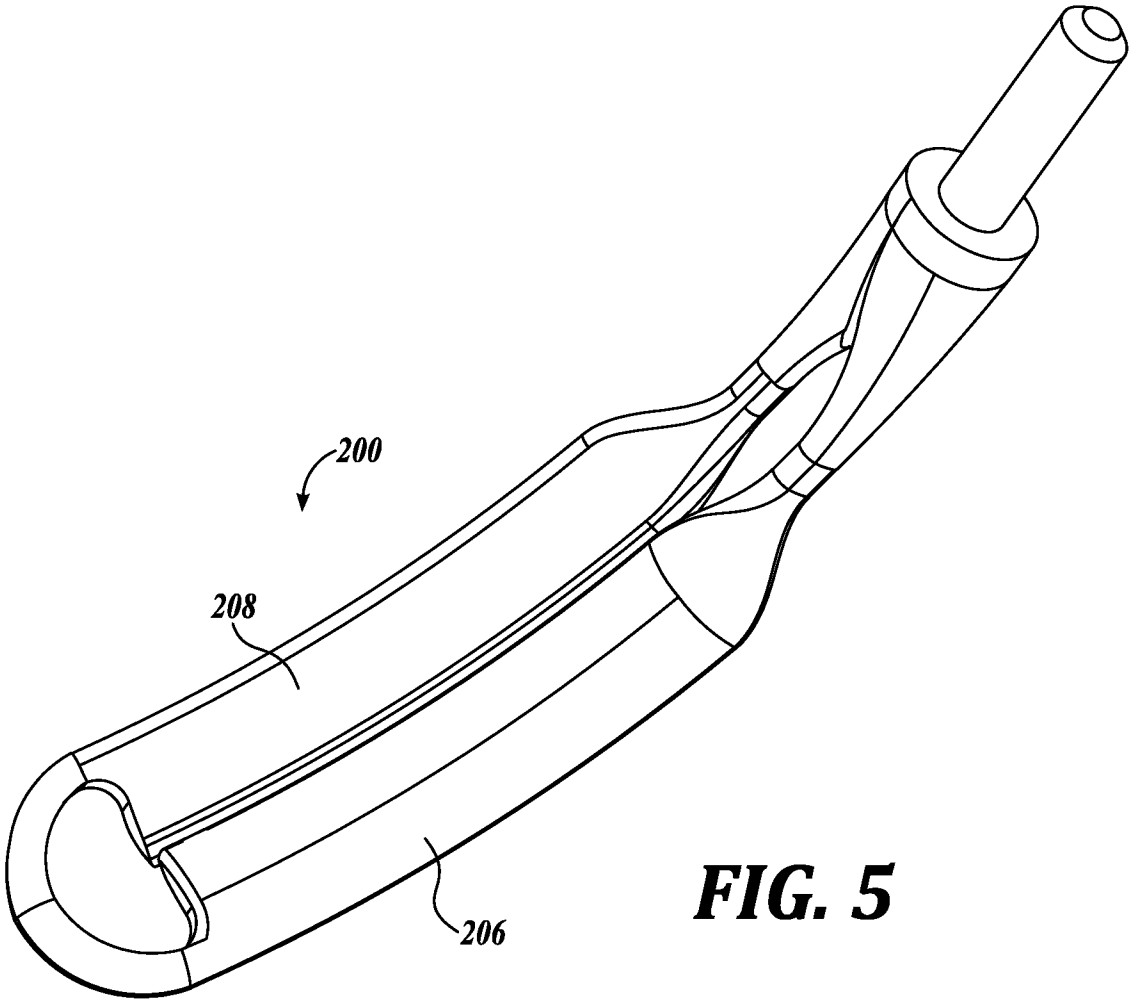
FIG. 5 is a diagrammatical illustration of an applicator in accordance with an embodiment of this disclosure.

Referring to FIG. 5, an embodiment of an applicator 200 is flexible to allow the tools 206, 208 to bend with the length of the applicator 200. To provide flexible applicator tools 206, 208, the selection of material includes elastomers or semi-rigid materials. Materials can include polyethylene, saturated and unsaturated rubbers, such as polyisoprene, polybutadiene, butyl rubber, nitrile rubber, ethylene propylene rubber, silicone, and the like.

In an embodiment, as shown in FIG. 1, to increase the flexibility of the tools 106, 108, a notch 128 can be provided at the end of the stem 102. The notch 128 extends in the axial direction from the end of the stem 102 toward the handle 104 and is a full diameter wide, so that it is bifurcated into two similar arms on opposite sides of the notch 128. The base of the spring 110*a* is connected to one of the arms and the base of the spring 110*b* is connected the second arm.

Figure 6:
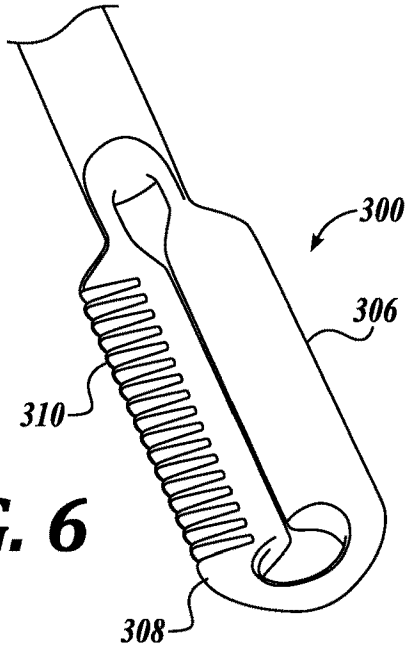
FIG. 6 is a diagrammatical illustration of an applicator in accordance with an embodiment of this disclosure.

Referring to FIG. 6, an embodiment of an applicator 300 has a first tool 306 which is a spatula and a second tool 308 which is a comb. A comb tool 308 has a plurality of teeth 310 extending outward. The length, width, and depth dimensions, materials and methods of applicator 300 can be similar to the dimensions, materials, and methods of the applicator 100 of FIGS. 1 to 4 as described herein.

Figure 7:
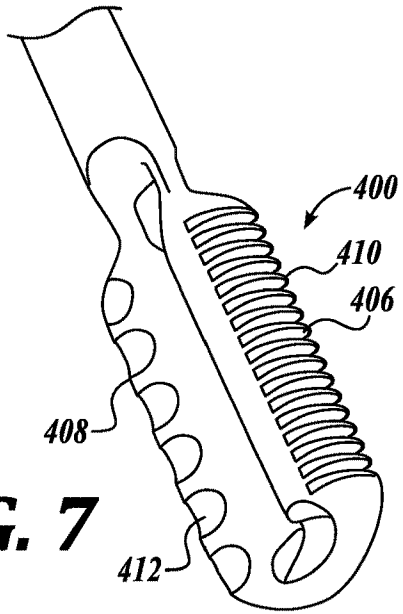
FIG. 7 is a diagrammatical illustration of an applicator in accordance with an embodiment of this disclosure.

Referring to FIG. 7, an embodiment of an applicator 400 has a first tool 406 which is a comb with teeth 410 and a second tool 408 which is a spatula which includes surface contouring 412. The surface contouring 412 can be described a scalloping, dimples, or kullens. The length, width, and depth dimensions, materials, and methods of applicator 300 can be similar to the dimensions, materials, and methods of the applicator 100 of FIGS. 1 to 4.

Figure 8:
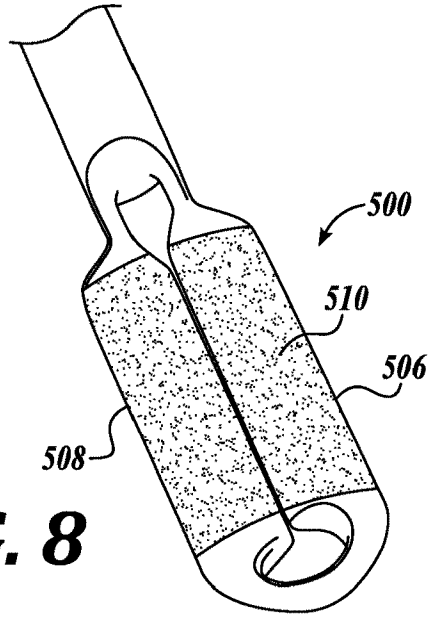
FIG. 8 is a diagrammatical illustration of an applicator in accordance with an embodiment of this disclosure.

Referring to FIG. 8, an embodiment of an applicator 500 has a first tool 506 which is a spatula and a second tool 508 which is a spatula. In an embodiment, the spatulas 506, 508 can be covered with flocking 510. In an embodiment, flocking 510 is composed of small fiber particles adhered to the surfaces of tools 506, 508. In an embodiment, wider surfaces with flocking 510 could hold and dispense larger amounts of thinner viscosity compositions. The length, width, and depth dimensions, materials and methods of applicator 500 can be similar to the dimensions, materials, and methods of the applicator 100 of FIGS. 1 to 4 as described herein.

Figure 9:
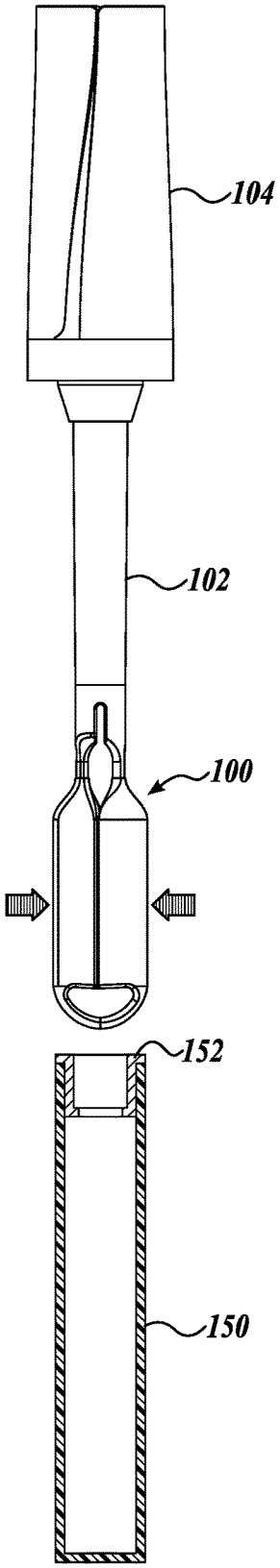
FIG. 9 is a diagrammatical illustration of an applicator and cosmetic package with wiper in accordance with an embodiment of this disclosure.

FIG. 9 is an illustration of an applicator 100 connected to a stem 102 which is further connected to a handle 104. The applicator 100, stem, 102, and handle 104 are used in combination with a package 150 which has a wiper 152. The package 150 can be a cosmetics package that includes mascara, or any other type of package containing a composition that is applied, such as nail polish, hair dye, and the like.

In an embodiment, the package 150 has a wiper 152 that is installed on or near the top of the package 150. Although the package 150 is illustrated as a cylindrical form, the package 150 can have any shape. In an embodiment, the package 150 can have any geometric form including regular or irregular forms including cylindrical, oblong, cuboid, and combinations of shapes. In an embodiment, the package 150 can be constructed out of a variety of materials including, for example, polymers, co-polymers, and blends or combinations thereof, etc. Other suitable materials include thermoplastic polymers, thermoplastic elastomers, glass, metals, and the like.

In an embodiment, the package 150 is made from one or more recyclable materials, compostable materials, sustainable materials, biodegradable materials, plant-based material, and the like. In an embodiment, the package 150 comprises one or more of biodegradable polymers, biodegradable polyesters, biodegradable polyurethanes, biodegradable starches, biodegradable cellulosic materials, biodegradable aliphatic polyesters, and the like.

In an embodiment, the wiper 152 has an circular or cylindrical orifice whose diameter is smaller than the width dimension of applicator 100, i.e., when tools 106 and 108 are in the static state, but, the wiper orifice is large enough to allow passage of the applicator 100 when the tools 106, 108 are in the compressed state. However, the wiper orifice can be designed to match the exterior contour of the applicator 100 in the compressed state, or conversely, applicators 100 can be designed with an exterior contour to match the interior shape of a wiper 152.

The handle 104 can be used to control the applicator 100 to insert it through the wiper 152 into the package 150. Inside of the package 150, the applicator 100 may expand once again to the static state after passing completely past the wiper 152. The composition inside the package 150 is transferred to the applicator 100. In an embodiment, the wiper 152 can function to remove composition from the applicator 100, and also helps to distribute the composition evenly onto the applicator 100. Once outside of the package 150, the expanded applicator 100 loaded with composition is used in applying the composition having about double the surface area as compared to conventional wipers.

While illustrative embodiments have been illustrated and described, it will be appreciated that various changes can be made therein without departing from the spirit and scope of the invention.

The embodiments of the invention in which an exclusive property or privilege is claimed are defined as follows:

1. An applicator, comprising:

a first applicator tool;

a second applicator tool, wherein the first and second applicator tools are positioned diagonally apart from each other; and the applicator has an overall width that decreases with the flexing of a spring holding the first and second applicator tools as the first and second tools overlap with each other, wherein the overall width of the applicator is configured to decrease from an expanded state to a compressed state, wherein the first and the second applicator tools are configured to remain parallel in the expanded state and in the compressed state, wherein the spring comprises a first spring and a second spring, the first spring connecting proximal ends of the first and second applicator tools, and the second spring connecting distal ends of the first and second applicator tools.

2. The applicator of claim 1, wherein the first and second applicator tools are configured to overlap each other in the compressed state.

3. The applicator of claim 1, wherein the first spring, the second spring, and the applicator tools are a single monolithic material.

4. The applicator of claim 1, wherein the first spring comprises a first neck and a second neck positioned opposite to each other.

5. The applicator of claim 1, wherein the second spring comprises a half-loop.

6. The applicator of claim 1, wherein the first applicator tool includes a spatula with a flat surface on one side and a convex surface on an opposite side.

7. The applicator of claim 1, wherein the first applicator tool and the second applicator tool each includes at least one tool selected from a spatula, a comb, or a spatula with surface contouring.

8. The applicator of claim 1, wherein at least one applicator tool includes flocking on a surface of the tool.

9. The applicator of claim 1, wherein the spring maintains the first applicator tool diagonally apart from the second applicator tool.

10. The applicator of claim 1, wherein the first applicator tool includes a first major surface that is flat, and the second applicator tool includes a second major surface that is flat, wherein the first major surface and the second major surface are parallel in the expanded state and in the compressed state, wherein the first major surface and the second major surface face inward toward each other in the expanded state and in the compressed state.

11. A combination, comprising:

applicator of claim 1; and a stem connected to the applicator through the spring.

12. The combination of claim 11, wherein the spring is connected to proximal ends of the first and second applicator tools, the spring comprises a first neck and a second neck positioned opposite to each other axially on the stem.

13. The combination of claim 12, comprising a notch extending into the stem, the notch is a full diameter of the stem, and divides the stem into a first and second arm to which the first and second neck are connected.

14. The combination of claim 11, wherein the applicator and stem are a single monolithic material.

15. The combination of claim 11, further comprising a package with a wiper.

16. The combination of claim 15, wherein the wiper has an orifice that has a width that is about half of the width of the applicator.

17. The combination of claim 15, wherein the package comprises a composition applied with the applicator.

* * * * *